US010542812B1

(12) United States Patent
Wade et al.

(10) Patent No.: US 10,542,812 B1
(45) Date of Patent: Jan. 28, 2020

(54) REPLACEABLE DEODORANT CARTRIDGE SYSTEM

(71) Applicants: Antoine Wade, Darien, IL (US); Karmen Wade, Darien, IL (US)

(72) Inventors: Antoine Wade, Darien, IL (US); Karmen Wade, Darien, IL (US)

( * ) Notice: Subject to any disclaimer, the term of this patent is extended or adjusted under 35 U.S.C. 154(b) by 0 days.

(21) Appl. No.: 15/821,625

(22) Filed: Nov. 22, 2017

Related U.S. Application Data

(60) Provisional application No. 62/426,096, filed on Nov. 23, 2016.

(51) Int. Cl.

| | |
|---|---|
| ***A45D 40/02*** | (2006.01) |
| ***B65D 83/00*** | (2006.01) |
| ***A45D 40/24*** | (2006.01) |
| ***A45D 40/16*** | (2006.01) |
| *A45D 40/00* | (2006.01) |

(52) U.S. Cl.
CPC ..... *A45D 40/02* (2013.01); *A45D 40/16* (2013.01); *A45D 40/24* (2013.01); *B65D 83/0005* (2013.01); *A45D 2040/0043* (2013.01)

(58) Field of Classification Search
CPC ..... A45D 40/02; A45D 40/16; A45D 40/24; A45D 2040/0043; B65D 83/0005
USPC ..... 401/176
See application file for complete search history.

(56) References Cited

U.S. PATENT DOCUMENTS

| | | | | | |
|---|---|---|---|---|---|
| 1,494,736 | A * | 5/1924 | Cottrell | A45D 40/02 | 132/289 |
| 2,043,250 | A * | 6/1936 | Kasdan | A45D 40/02 | 132/318 |
| 5,167,462 | A * | 12/1992 | Lucas | A45D 40/02 | 401/82 |
| 5,800,086 | A * | 9/1998 | Piscopo | A45D 40/02 | 401/82 |
| 5,997,202 | A * | 12/1999 | Durocher | A45D 40/12 | 401/83 |
| 2017/0325570 | A1* | 11/2017 | Davtyan | A45D 40/24 | |
| 2017/0354236 | A1* | 12/2017 | Corsi | A45D 40/02 | |

* cited by examiner

*Primary Examiner* — Huyen D Le
(74) *Attorney, Agent, or Firm* — Quickpatents, LLC; Kevin Prince

(57) ABSTRACT

A deodorant system includes a substantially hollow, elongated housing open at either one or two opposing ends. The housing includes a peripheral wall that has at least one slot therethrough, the peripheral wall preferably including a front wall, a rear wall, and two opposing side walls that each includes one of the slots. A piston is slidably retained within the housing and has a cartridge attachment mechanism on a first and optionally a second side thereof. An actuator projects through each slot of the housing and is selectively positionable along the slot to position the piston within the housing. An interchangeable deodorant cartridge has a rigid base with a cooperative cartridge attachment mechanism on a bottom side thereof for attaching to the cartridge attachment mechanism of either one or two sides of the piston. A top side of the rigid base is fixed with a deodorant material.

12 Claims, 2 Drawing Sheets

REPLACEABLE DEODORANT CARTRIDGE SYSTEM

CROSS-REFERENCE TO RELATED APPLICATIONS

This application claims the benefit of U.S. Provisional Patent Application 62/426,096, filed on Nov. 23, 2016, and incorporated herein by reference.

STATEMENT REGARDING FEDERALLY SPONSORED RESEARCH AND DEVELOPMENT

Not Applicable.

FIELD OF THE INVENTION

This invention relates to personal product dispensing, and more particularly to an interchangeable deodorant dispenser.

DISCUSSION OF RELATED ART

A significant amount of plastic is used with deodorant products, and once the deodorant material of such products has been used the container and various plastic pistons and screw dials typically found in such products is disposed of in a landfill. Further, such products are personal in nature, so every person sharing a bathroom typically has their own deodorant, often resulting in crowded medicine cabinets or bathroom drawers.

Therefore, there is a need for a system that provides for one or two different, interchangeable deodorant cartridges to be used with the same reusable container. Such a needed invention would allow for a variety of different, interchangeable deodorant products to be used based on the preferences of each user, and could be shared by two people or simply provide more variety to a single user. Such a needed system would reduce landfill waste and, at the same time, be relatively inexpensive to manufacture and easy to use. The present invention accomplishes these objectives.

SUMMARY OF THE INVENTION

The present device is a deodorant system. A substantially hollow, elongated housing is open at one end in one embodiment, and at two opposing ends in another embodiment. The housing includes a peripheral wall that has at least one slot therethrough, the peripheral wall preferably including a front wall, a rear wall, and two opposing side walls that each include one of the slots. A removable cap may be included for each open end and adapted to be selectively fixed over the open end of the housing.

A piston is slidably retained within the housing and has a cartridge attachment mechanism on a first side thereof. In the embodiment having two opposing openings in the housing, the piston includes the cartridge attachment mechanism on both the first side and a second side. An actuator projects through each slot of the housing and is selectively positionable along the slot to position the piston within the housing.

An interchangeable deodorant cartridge has a rigid base with a cooperative cartridge attachment mechanism on a bottom side thereof. The cooperative cartridge attachment mechanism cooperatively attaches to the cartridge attachment mechanism of the piston. A top side of the rigid base is fixed with a deodorant material. In the embodiment wherein the housing has two open ends, two of the deodorant cartridges are each fixed on the opposing sides of the piston.

In use, with a desired deodorant cartridge engaged with the piston at the cartridge attachment mechanism thereof, the piston and deodorant cartridge can be positioned by sliding the actuator such that the deodorant material extends past the open end, of the housing or is retracted fully within the housing, for storage or transport, for example.

In one embodiment the piston and housing include a detent mechanism so that the piston can be positioned in one of a plurality of discrete detent positions along the slot. In one embodiment, the cartridge attachment mechanism is a projecting tab having a friction fit with the cooperative cartridge attachment mechanism of the deodorant cartridge. As such the cartridge can be manually removed and replaced from the piston manually, preferably when the piston is in a fully extended position. The cartridge attachment mechanism may include an undercut slot corresponding with the cooperative cartridge attachment mechanism, such that the cartridge may be manually slid away from the piston laterally only when the piston is in the fully extended position towards one of the open ends of the housing.

The present invention is a system that provides for one or two different, interchangeable deodorant cartridges to be used with the same reusable container. Such a device allows for a variety of different, interchangeable deodorant products to be used based on the preferences of each user, and can be shared by two people or simply provide more variety to a single user. Widespread use of the present invention reduces landfill waste to help the environment, whiling being relatively inexpensive to manufacture and easy to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 2:
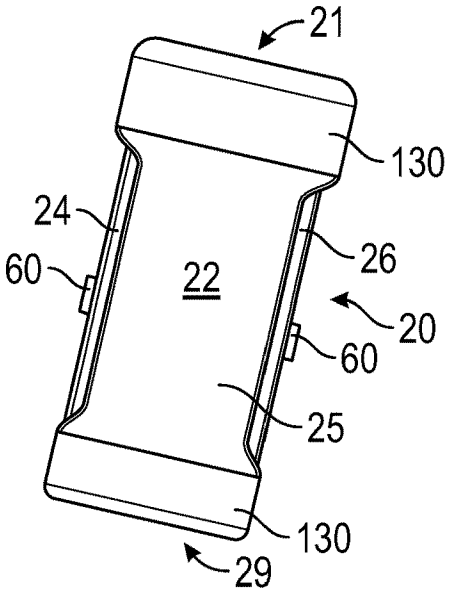
FIG. 2 is a front elevational view of the invention.
Figure 1:
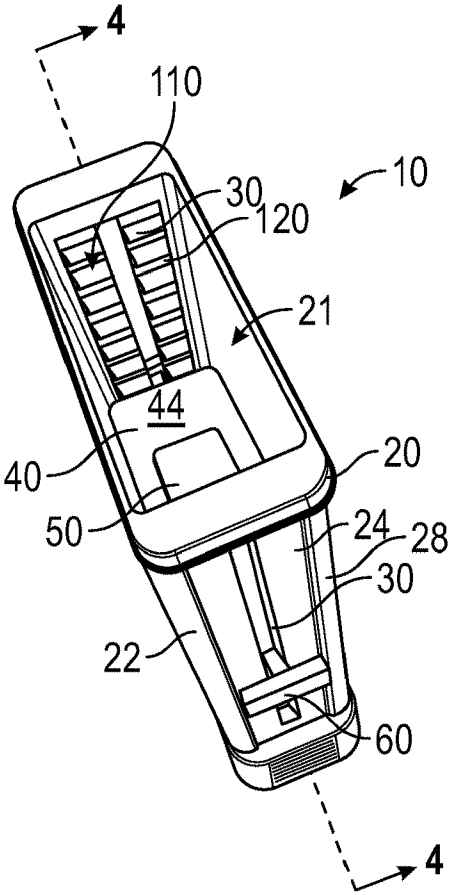
FIG. 1 is a perspective view of the invention, illustrate with a deodorant material omitted for clarity of illustration.

FIGS. 1 and 2 illustrate a deodorant system 10. A substantially hollow, elongated housing 20 is open at one end 21 in one embodiment and at two opposing ends 21,29 in another embodiment. The housing 20 includes a peripheral wall 25 that has at least one slot 30 therethrough, the peripheral wall 25 preferably including a front wall 22, a rear wall 28, and two opposing sides wall 24,26 that each include one of the slots 30. A removable cap 130 may be included for each open end 21,29 and adapted to be selectively fixed over the open end 21,29 of the housing 20.

A piston 40 is slidably retained within the housing 20 and has a cartridge attachment mechanism 50 on a first side 44 thereof. In the embodiment having two opposing openings in the housing 20, the piston 40 includes the cartridge attachment mechanism 50 on both the first side 44 and a second side 46. An actuator 60 projects through each of the at least one slot 30 of the enclosure 20. Each actuator 60 is selectively positionable along the slot 30 to position the piston 40 within the housing 20.

Figure 4:
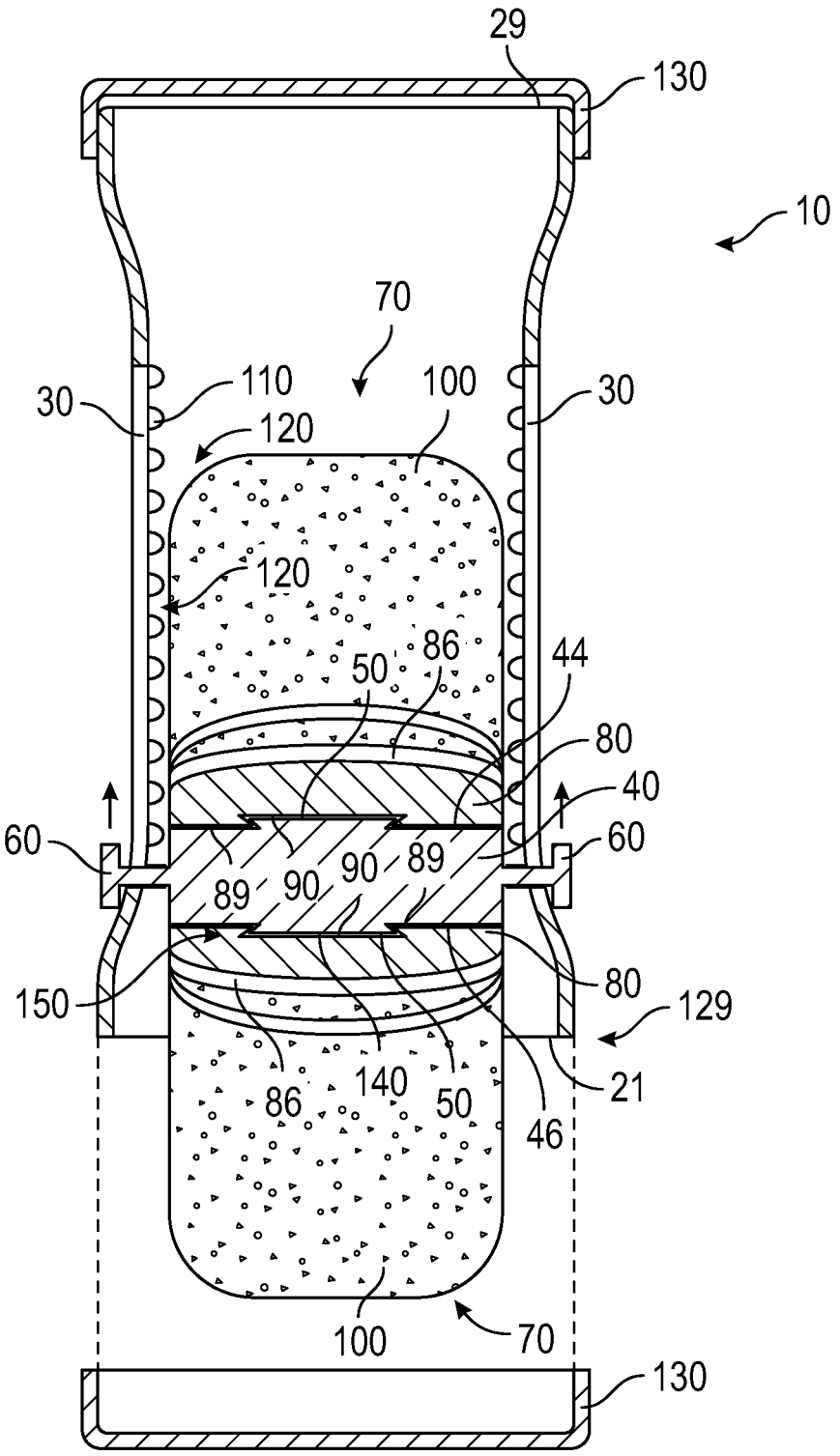
FIG. 4 is a cross-sectional view of the invention, taken along lines 4-4 of FIG. 1.

A deodorant cartridge 70 has a rigid base 80 with a cooperative cartridge attachment mechanism 90 on a bottom side 84 thereof. The cooperative cartridge attachment mechanism 90 cooperatively attaches to the cartridge attachment mechanism 50 of the piston 40 (FIG. 4). A top side 86 of the rigid base 80 is fixed with a deodorant material 100. In the embodiment wherein the housing 20 has two open ends 21,29, two of the deodorant cartridges 70 are each fixed on the opposing sides 44,46 of the piston 40 (FIG. 4).

The housing 20, piston 40 and rigid base 80 are preferably made from a rigid injection molded plastic material, but can also be machined from a metallic material or the like. The deodorant material 100 may be of various types depending on the preference of the user, and may be sold separately or together with the housing 20 and piston 40.

In use, with the deodorant cartridge 70 engaged with the piston 40 at the cartridge attachment mechanism thereof, the piston 40 and deodorant cartridge 70 can be positioned by sliding the actuator 60 such that the deodorant material 100 extends past the open end 21,29 of the housing 20 or is retracted fully within the housing 20 for storage, for example.

In one embodiment the piston 40 and housing 20 include a detent mechanism 110 so that the piston 40 can be positioned in one of a plurality of discrete detent positions 120 along the slot 30.

Figure 3:
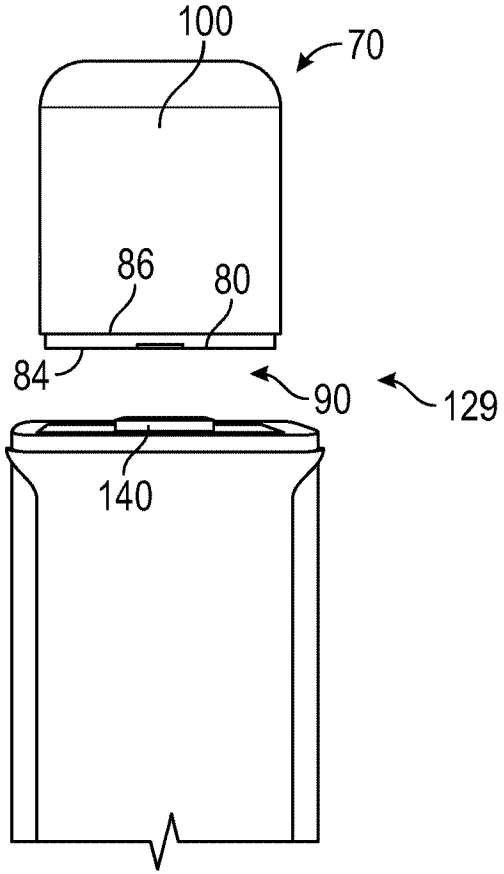
FIG. 3 is a partial, exploded front elevational view of the invention.

In one embodiment, the cartridge attachment mechanism 50 is a projecting tab 140 having a friction fit with the cooperative cartridge attachment mechanism 90 of the deodorant cartridge 70. As such the cartridge 70 can be manually removed and replaced from the piston 40 manually, preferably when the piston 40 is in a fully extended position 129 (FIG. 3). The cartridge attachment mechanism 50 may include an undercut slot 150 corresponding with the cooperative cartridge attachment mechanism 90, such that the cartridge 70 may be manually slid away from the piston 40 laterally only when the piston 40 is in the fully extended position 129 towards one of the open ends 21,29 of the housing.

While a particular form of the invention has been illustrated and described, it will be apparent that various modifications can be made without departing from the spirit and scope of the invention. For example, the housing may be an elongated oval shape instead of an elongated generally rectangular shape. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A deodorant system, comprising:

a substantially hollow, elongated housing open at one end and including a peripheral wall having at least one slot therethrough;

a piston slidably retained within the housing and having a cartridge attachment mechanism on a first side thereof and an actuator projecting through each of the at least one slot of the enclosure, the at least one actuator selectively positionable along the slot to selectively position the piston within the housing;

a deodorant cartridge having a rigid base with a cooperative cartridge attachment mechanism on a bottom side thereof and a top side fixed with a deodorant material;

wherein the cartridge attachment mechanism is a projecting tab having a friction fit with the cooperative cartridge attachment mechanism of the deodorant cartridge, whereby the cartridge can be manually removed from the piston; and wherein the cartridge attachment mechanism further includes an undercut slot corresponding with the cooperative cartridge attachment mechanism of the deodorant cartridge, whereby the cartridge may be selectively manually slid away from the piston laterally only when the piston is in a fully extended position towards the open end of the housing;

whereby with the deodorant cartridge engaged with the piston at the cartridge attachment mechanisms thereof, the piston and deodorant cartridge can be positioned by sliding the actuator such that the deodorant material extends past the open end of the housing or is retracted fully within the housing.

2. The deodorant system of claim 1 wherein the piston and the housing include a detent mechanism so that the piston can be positioned in one of a plurality of detent positions along the slot.

3. The deodorant system of claim 1 further including a removable cap adapted to be selectively fixed over the open end of the housing.

4. The deodorant system of claim 1 wherein the housing includes two of the slots on opposing sides of the housing, and wherein the piston includes two of the actuators projecting away from opposing sides thereof.

5. The deodorant system of claim 4 wherein the peripheral wall of the housing includes a front wall opposing a rear wall, and two opposing side walls, each slot traversing one of the side walls.

6. A deodorant system, comprising:

a substantially hollow, elongated housing open at two opposing ends and including a peripheral wall having at least one slot therethrough;

a piston slidably retained within the housing and having cartridge attachment mechanisms on a first and second opposing sides thereof and an actuator projecting through each of the at least one slot of the enclosure, the at least one actuator selectively positionable along the slot to selectively position the piston within the housing;

a pair of deodorant cartridges each having a rigid base with a cooperative cartridge attachment mechanism on a bottom side thereof and a top side fixed with a deodorant material;

whereby with the deodorant cartridges each engaged with the piston at the cartridge attachment mechanisms thereof, the piston and deodorant cartridges can be positioned by sliding the actuator such that the deodorant material extends past one or the other open end of the housing or is retracted fully within the housing.

7. The deodorant system of claim 6 wherein the piston and the housing include a detent mechanism so that the piston can be positioned in one of a plurality of detent positions along the slot.

8. The deodorant system of claim 6 further including a pair of removable caps each adapted to be selectively fixed over one of the open ends of the housing.

9. The deodorant system of claim 6 wherein each cartridge attachment mechanism is a projecting tab having a friction fit with the cooperative cartridge attachment mechanism of the deodorant cartridge, whereby the cartridge can be manually removed from the piston.

10. The deodorant system of claim 9 wherein the cartridge attachment mechanism further includes an undercut slot corresponding with the cooperative cartridge attachment mechanism of the deodorant cartridge, whereby each cartridge may be selectively manually slid away from the piston laterally only when the piston is in a fully extended position towards one of the open ends of the housing.

11. The deodorant system of claim 6 wherein the housing includes two of the slots on opposing sides of the housing, and wherein the piston includes two of the actuators projecting away from opposing sides thereof.

12. The deodorant system of claim 11 wherein the peripheral wall of the housing includes a front wall opposing a rear wall, and two opposing side walls, each slot traversing one of the side walls.

* * * * *